US007364512B2

(12) United States Patent
Graedener

(10) Patent No.: US 7,364,512 B2
(45) Date of Patent: Apr. 29, 2008

(54) GOLF SWING TRAINER

(75) Inventor: Alina Graedener, Savignyplatz 5, Berlin 10623 (DE)

(73) Assignees: Alina Graedener, Berlin (DE); Leo Rokeach, Berlin (DE)

( * ) Notice: Subject to any disclaimer, the term of this patent is extended or adjusted under 35 U.S.C. 154(b) by 151 days.

(21) Appl. No.: 11/150,274

(22) Filed: Jun. 13, 2005

(65) Prior Publication Data

US 2006/0073903 A1 Apr. 6, 2006

Related U.S. Application Data

(60) Provisional application No. 60/632,200, filed on Dec. 2, 2004.

(30) Foreign Application Priority Data

Oct. 1, 2004 (DE) ..... 10 2004 048 364

(51) Int. Cl.
*A63B 69/36* (2006.01)

(52) U.S. Cl. ..... 473/219; 473/226; 473/229; 473/409

(58) Field of Classification Search ..... 473/219, 473/221, 223, 229, 257, 258, 260, 266
See application file for complete search history.

(56) References Cited

U.S. PATENT DOCUMENTS 1,703,403 A 2/1929 Mesple
1,854,392 A 4/1932 Bambrick
2,472,065 A * 6/1949 Cottingham ..... 473/229
2,737,432 A 3/1956 Jenks
3,415,523 A 12/1968 Boldt
3,876,212 A * 4/1975 Oppenheimer ..... 473/221
4,261,573 A * 4/1981 Richards ..... 473/229
5,330,192 A 7/1994 Amos
5,474,299 A 12/1995 Romano (Continued)

FOREIGN PATENT DOCUMENTS

EP 0965367 12/1999

(Continued)

OTHER PUBLICATIONS

Feb. 28, 2006, PCT ISR PCT/EP2005/010068.

(Continued)

*Primary Examiner*—Nini F. Legesse
(74) *Attorney, Agent, or Firm*—Neifeld IP Law, PC

(57) ABSTRACT

The invention pertains to a golf swing trainer with a base (70) and a plurality of elongated elements (S1 to S6), each of which comprises a near end (103) and a distant end (102). Moreover, a plurality of first motion devices (48, 80) is provided, each connected to the near end (103) of one of the plurality of elongated elements (S1 to S6) and designed to move, in each case, one of the plurality of elongated Elements (S1 to S6) relative to base (70). The distant ends (102) of the elongated elements (S1 to S6) are movably connected to a platform (8). The golf swing trainer may be connected to a golf club (7) and/or a golfer via a connector device (10), such that a motion of the elongated elements (S1 to S6) is capable of effecting a motion of the golf club (7) and/or of the golfer.

27 Claims, 10 Drawing Sheets

U.S. PATENT DOCUMENTS

| | | | | |
|---|---|---|---|---|
| 5,711,717 | A * | 1/1998 | Richards | 473/229 |
| 6,240,799 | B1 | 6/2001 | Yau | |
| 6,277,030 | B1 * | 8/2001 | Baynton et al. | 473/219 |
| 6,390,930 | B1 | 5/2002 | Gauer | |

FOREIGN PATENT DOCUMENTS

| | | |
|---|---|---|
| JP | 04-146775 | 5/1992 |
| JP | 08-280852 | 10/1996 |
| JP | 2001-190729 | 7/2001 |
| JP | 2004-105597 | 4/2004 |
| WO | WO 98/31438 | 7/1998 |

OTHER PUBLICATIONS

Feb. 28, 2006, PCT Written Opinion of the International Search Authority.

Aug. 5, 2005, Graedener, Inventor's declaration of material publications.

Oct. 15, 2004, Internet description of golf swing trainer, URL: http://www.tposwing.de/.

Jan. 24, 2005, Prospectus of Golf Swing Trainer.

* cited by examiner

GOLF SWING TRAINER

CROSS REFERENCE TO RELATED APPLICATIONS

This application claims the benefit of the filing date of German patent application DE 10 2004 048 364.7, filed Oct. 1, 2004; this application also claims the benefit of the filing date of US provisional application 60/632,200, filed Dec. 2, 2004 entitled "Golf Swing Trainer".

German patent application DE 10 2004 048 364.7 and US provisional application 60/632,200 are incorporated herein by reference.

FIELD OF THE INVENTION

The invention pertains to a golf swing trainer and a process for operating a golf swing trainer.

BACKGROUND OF THE INVENTION

The invention pertains to a golf swing trainer and a process for operating a golf swing trainer.

DISCUSSION OF THE BACKGROUND

A golf swing trainer has been known, for example, as a result of U.S. Pat. No. 5,474,299. The said golf swing trainer comprises a rotor rotating about a rotational axis while the golfer is practicing the golf swing. The golfer connects himself or the golf club shaft to the rotor. For this purpose, the rotor may be flexible, so that deviations of the golf swing from an ideal path will cause the rotor to be distorted.

The disadvantages of the said known golf swing trainer are its limited options for adjusting to the golf swings of different golfers. Moreover, the settings of the golf swing trainer as described in U.S. Pat. No. 5,474,299 are complicated and awkward. Furthermore, the rotor permits only one rotation about a preset rotational axis. However, since the golf club only remotely approximates a circular path during an ideal golf swing move, the golf swing trainer is not capable of training for an ideal golf swing.

SUMMARY OF THE INVENTION

It is an object of the present invention to specify a golf swing trainer which permits a plurality of possible motion sequences by the golf club and/or different golfers, wherein a golf swing can be trained which does not correspond to a circular motion. In particular, moving parts of the golf swing trainer should exhibit a low level of inertia, and the golf swing trainer should be mechanically stable during rapid golf swing motions.

The proposal is made to use parallel kinematics for a golf swing trainer, wherein forces and/or torques between a base, on the one hand, and the golf club and/or golfer, on the other hand, are transmitted via a plurality of kinematically parallel elements of the golf swing trainer. Toward this end, parallel kinematics with an arrangement of six kinematically parallel elements have proven to be of particular advantage. However, other arrays are also possible on general principle, such as ones with five kinematically parallel elements, for example. In contrast with purely serial kinematics, parallel kinematics can be low in weight while nevertheless being mechanically very stable. Due to the low weight of the moving elements, there is little inertia. Furthermore, parallel kinematics can be of very rigid design as a whole in spite of their low weight, so that vibrations occurring in motion can be suppressed or excluded. Therefore, it is possible to precisely control the golf trainer's motion both temporally and locally with little expense of energy.

In particular, a golf swing trainer is proposed with:

- a base,
- a plurality of elongated elements, each having a near end as well as a distant end,
- a plurality of first motion devices, each connected to the near end of one of the plurality of elongated elements and designed to move one of the plurality of elongated elements relative to the base,
- a platform movably connected to the distant ends of the elongated elements, and
- a connector device designed to connect the golf swing trainer with a golf club and/or with a golfer, such that a motion of the elongated elements can effect a motion of the golf club and/or the golfer.

In particular, the base is designed to be locally fixed relative to the golfer's feet, as long as the golfer stands in one place and does not move his feet. To this end, the base may, for example, comprise a plate at its underside which is placed on a floor. Alternatively, the base may merely contact the floor in places. Furthermore, the base may be a framed stand to which the first motion devices are attached.

The term platform is understood to mean a rigid construction element of any shape. It does not necessarily have to be a construction element having a planar surface, even though this is the case in a tangible implementation of the invention. In particular, the distant ends (viewed from the base) of the elongated elements may engage one point of the platform and/or be attached to this point in an articulated fashion, wherein all the points may be arranged in one common plane. If (as preferred) each of the elongated elements is connected to the platform by a cardan joint, then the intersections of the joint axes of the cardan joints are preferably in the same common plane. The platform may have cutouts for the purpose of weight reduction. The platform (the rigid construction element) may also be made of several structural parts.

At least one of the elongated elements may be connected to the platform via a cardan joint and/or to the base via a cardan joint. A cardan joint is understood to mean a joint with two rotating axes transversely extending (preferably vertically) to one another which the joint permits to move around. In so doing, the rotating axes cross, one of the rotating axes extending in the direction of a longitudinal axis of the elongated element.

In a particularly preferred implementation, said at least one of the elongated elements is connected to the platform by a cardan joint and to the base by a cardan joint. Therein, the elongated element has a revolute joint, such that the near end and the distant end of the elongated element can be independently rotated about a longitudinal axis of the elongated element. Moreover, each of the elongated elements is preferably so equipped and connected by an articulated joint. Owing to this implementation, forces are transmitted with very close approximation between the base and the platform in longitudinal direction exclusively, i.e. in the direction of the longitudinal axis of the elongated element.

The platform serves the purpose of transmitting forces and torques between the base on the one hand, and the golf club and/or golfer on the other. Preferably, these forces and moments are transmitted exclusively via the platform. In that case, there is no device for transferring forces and moments which is arranged in a kinematically parallel fashion versus the platform. However, this does not preclude the generation of additional forces and/or moments in series with respect to the platform.

In particular, the platform may be connected to the connector device in rotatable fashion, wherein a second motion device is provided which is designed to turn the connector device about a rotational axis relative to the platform. Preferably, a kinematic series connection is established by the platform and the motion device, such that the forces and torques transmitted from the base via the platform are exclusively transmitted to the golf club and/or the golfer via a portion of the second motion device. The said series connection is a simply executed option. It has the advantage of retaining the advantages of parallel kinematics while also providing the motion of the golf club and/or golfer with a very large range of motion with respect to one degree of freedom. As mentioned above, the striking end of the golf club only remotely approximates a circular motion during the golf swing. The golf swing trainer is preferably designed such that the degree of freedom accompanied by a very large range of motion is a rotational degree of freedom which corresponds to the circular motion or permits this circular motion. As a result, the range of motion may be designed to be smaller for the appropriate rotational motions of the platform. In particular, the elongated elements can therefore be arranged closer to each other and/or be shorter, resulting in a space-saving effect.

Preferably, a golf club shaft is rotatable about its longitudinal axis when the connector is connected to the golf club. This rotation about the longitudinal axis may be driven by an additional (e.g., a third) motion device, the rotation being capable of being controlled by a control device of the golf swing trainer.

The elongated elements, their connections to the base and/or their connections to the platform may be of identical design, allowing for reduced effort and cost in manufacturing the golf swing trainer. In particular, the elongated elements are rod-like elements (e.g., tubular, at least in part) preferably essentially rotation-symmetrical with respect to their longitudinal axis. In particular, the length of the elongated elements is invariable in their longitudinal direction.

Preferably, the elongated elements form a hexapod, so called, i.e. there are six elongated elements in a kinematically parallel arrangement. The elongated elements need not be feet in the sense of directly connecting the platform with a floor. A hexapod is especially well suited for application as a golf swing trainer because it can be constructed in an especially light and stable fashion, is simple, straightforward and precise to control (in this context, the advantages of a Stewart Platform, so called, are pointed out, as described, for example in U.S. Pat. No. 6,240,799 B1), and offers the platform a large scope of motion with respect to all six independent degrees of freedom of motion.

At least one (preferably all) of the first motion devices may be a linear motion device designed to move one from among the plurality of elongated elements linearly along a specifically straight line, the straight line being locally fixed relative to the base. The first motion device may, for example, comprise one toothed-belt forward feed (a linear forward feed driven via a toothed belt) each, e.g. the toothed-belt forward feed (Zahnriemenvorschub) ZF 3 by Isel Automation KG, Buergermeister-Ebert-Strasse 40, 36124 Eichenzell, Germany. Moreover, use of a hexapod permits two of the elongated elements to be moved along two each of straight lines, e.g. parallel-running, at the base. In particular, two of these three pairs of straight lines may be in parallel arrangements, the lines sloping from top to bottom in the direction of the platform.

As an alternative to the linear motion devices, one or more of the elongated elements may be adjustable in length in their longitudinal direction, i.e. a distance between the near end and the distant end may be adjustable. The first motion device is appropriately designed and, for example, comprises a controllable lifting piston with regard to its lifting motion. Other drives are possible as well, as for example a linear motor arranged in the elongated element. In general terms, at least one of the elongated elements may be a length-adjustable telescoped element.

Each of the first motion devices is capable of transmitting forces and/or torques to one of the elongated elements and, in particular, may comprise a motor, e.g. a pulse motor, which drives the motion of the elongated elements, e.g. via a toothed belt. Moreover, it is preferred that motion positions of the first motion devices and/or the elongated elements should be determinable by means of a measuring device. The properties and/or characteristics described in this paragraph may be appropriately applied to the second motion device. Use of a servomotor for the drive is preferred in that case.

The golf club need not be a club meeting golf standards, even though that would be preferable. Instead, the golf club may, for example, be especially designed for training with the golf swing trainer and merely serve as a suitable object for a golf player to hold as he would a golf club. In particular, the golf club comprises a shaft with an area by which it is gripped.

The connector device may, for example, be a gripping device for holding the shaft of a golf club or for holding at least one arm and/or at least one hand of the golfer, the gripping device being connected to the platform.

Within the possible range of motion, the platform of the golf swing trainer may be arbitrarily positioned and oriented, the motion range being very great in particular for rotatory motion. As a result, various golf swings may be trained, in particular by golfers of various size.

The golf swing trainer may comprise a control device, the control device being in each case connected to the motion devices via control connectors, such that motions made by the motion devices are controllable by the control device.

Furthermore, a method is proposed for operating a golf swing trainer (in particular the golf swing trainer in one of the implementations described above), the golf swing trainer comprising a plurality of elongated elements, wherein the elongated elements comprise a near end and a distant end, wherein the near ends of the elongated elements are connected to a locally fixed base, wherein the distant ends of the elongated elements are movably connected to a platform, wherein the platform is connected to a golf club and/or a golfer via a connecting device, and wherein a motion of the distant ends relative to the base a golf swing motion generates a golf swing motion of the golf club and/or the golfer, and/or influences a golf swing motion performed by the golfer.

Regarding the advantages of this process, reference is made to the above-described advantages of parallel kinematics. Moreover, it is easy to operate the golf swing trainer as described because only the elongated elements have to be moved. This type of motion can be substantially easier than the complicated golf swing motion. In particular, the elongated elements can only be moved in a straight line. Given an adequate number of elongated elements, or additional arrangements, a golf swing motion can thus be generated which is adjustable with respect to all six of the independent degrees of freedom of motion.

Preferably, the lengths of at least some of the elongated elements are invariable and the motion of the distant end of these elongated elements is brought about by moving the near end relative to the base. Such motion is easily generated, in particular when the near end is moved by being moved along a rectilinear linear axis positioned in a fixed location relative to the base.

In each instant, forces between the base and the platform are preferably transmitted exclusively in the direction of longitudinal axes of the elongated elements.

In one particularly preferred implementation, a total of six of the elongated elements are used.

The connector device may be rotated relative to the platform, such that partial components of the golf swing motion are executed and/or influenced. Partial components are understood to mean components or parts of components of the motion, wherein components are intended to mean geometrical components (e.g. components of a speed vector of the motion).

BRIEF DESCRIPTION OF THE DRAWINGS

Sample implementations of the invention with a particularly preferred type of implementation of the golf swing trainer will now be described by reference to the enclosed drawing. However, the invention is not limited to these sample implementations. Individual characteristics or combinations of characteristics of the sample implementations may be combined with the above-described implementations and designs of the invention. The individual figures of the drawing show.

DETAILED DESCRIPTION OF THE EMBODIMENTS

Figure 1:
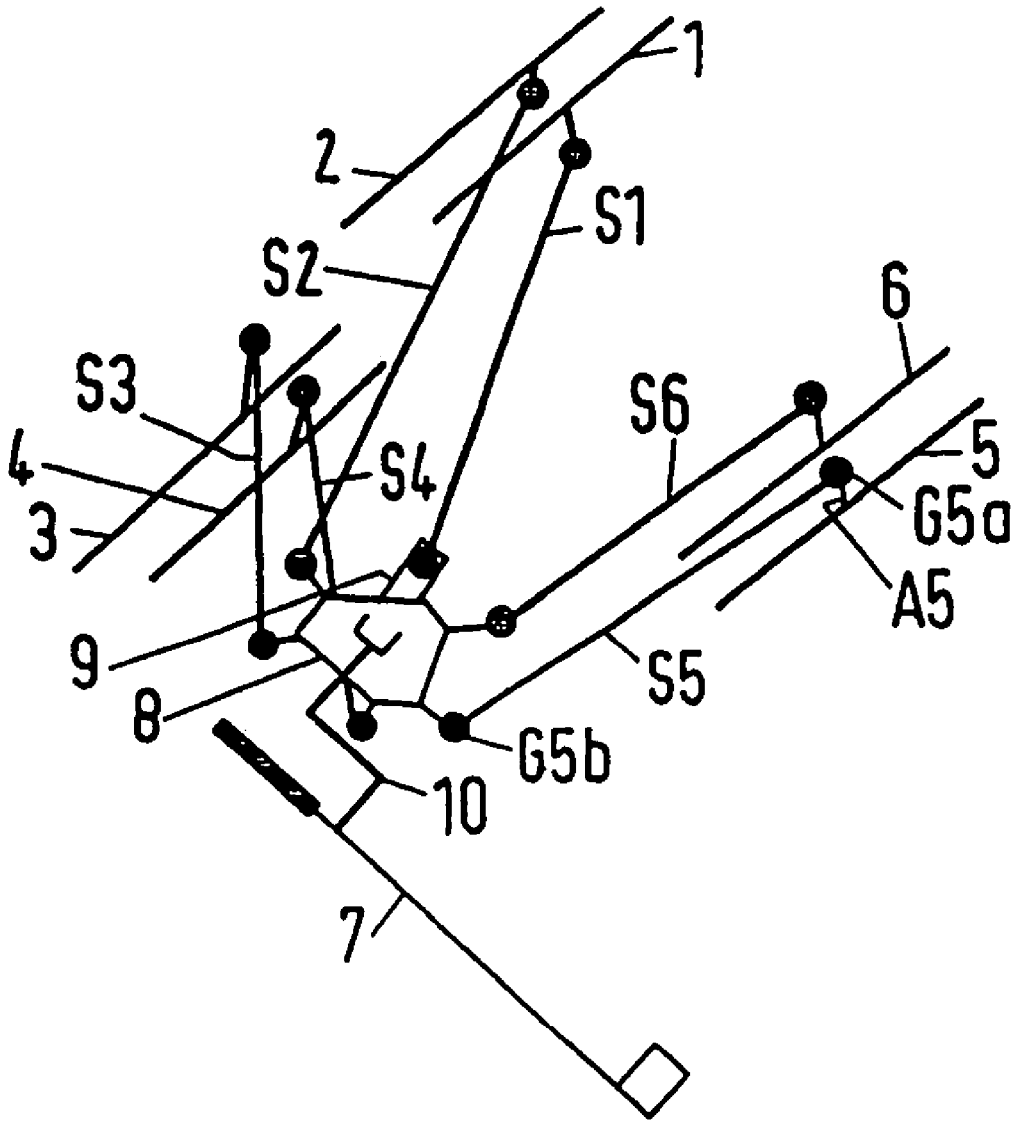
FIG. 1 a three-dimensional schematic drawing of a particularly preferred implementation of a golf swing trainer, in which, however, drive units and the base have been omitted, FIG. 2 the kinematic design of a portion of the arrangement shown in FIG. 1, FIG. 3 a vector illustration for a linear motion along one of the linear axes illustrated in FIG. 2, FIG. 4 systems of coordinates for driven parts (Abtrieb) and the platform, FIG. 5 loads on the platform shown in a cutaway drawing, FIG. 6 an array for controlling the operation of a golf swing trainer, FIG. 7 a base to which, for example, the array shown in FIG. 1 may be attached, FIG. 8 in a side view, a linear forward feed, in particular a toothed-belt forward feed, for the linear movement of an elongated element, FIG. 9 the linear forward feed shown in FIG. 8, viewed from the top, FIG. 10 a particularly preferred implementation of an elongated element, wherein a longitudinal portion is shown cut away, FIG. 11 a joining element for a mechanical movable connection between the base and an elongated element, FIG. 12 the joining element shown in FIG. 11 with an elongated element attached thereto, and FIG. 13 a platform with a connector device and golf club shaft.

The golf swing trainer shown in FIG. 1 comprises six elongated elements S1 to S6, each of invariable length. Furthermore, the golf swing trainer comprises six rectilinear axes 1 to 6, along which near ends of elements S1 to S6 may be moved in a straight line. For example, elements S1 to S6 are connected to axis 1 to 6, in each case via a joining element leading along axis 1 to 6 (for example designated A5 for axis 5 and elongated element S5), wherein joining element A5 is connected to element S1 to S6 via a first cardan joint (for example, designated G5*a* for element S5). The distant ends of elements S1 to S6 are, for example, connected to a platform 8 via a cardan joint (for example, designated G5*b* for element S5). Thus, there is a total of six first cardan joints and six second cardan joints. As a result, platform 8 can only be moved by the linear motions of the near elements with six independent degrees of freedom (three degrees of translational freedom and three degrees of rotational freedom).

A second motion device 9 is arranged on platform 8, such that operation of motion device 9 permits a connector device 10 to be rotated about an axis of rotation which is fixed relative to platform 8. A golf club 7 is attached to a distant end of connector device 10, wherein golf club 7 can be freely rotated about the longitudinal axis of its shaft against connector device 10. For this purpose, a fastening element for connector device 10, equipped with an appropriately rotatable bearing, may be immovably affixed to the shaft.

Details for a specific, particularly preferred implementation of the golf swing trainer will follow below.

The kinematics of a hexapod, i.e. of a golf swing trainer with six elongated elements in kinematically parallel arrangement for transmission of forces, may be described as follows. In this context, it is assumed that, in each case, the motion devices move the near ends of the elongated elements along a rectilinear axis (hereafter: linear drives or linear axes). Moreover, the elongated elements comprise fixed (i.e., invariable in spite of the motion) longitudinal lengths (hereafter simply called "rod lengths", even if elongated elements used differ from rods). In the sample implementation of the golf swing trainer, the spaces between the focal points of the cardan joints for each of the elongated elements are fixed.

The kinematics at the hexapod are first considered. Next, additional interrelations are explained for a hexapod with an additional degree of rotational freedom, the rotation being possible between the platform and the connector device. Thus, there exist serial kinematics in which the hexapod is arranged in series to the auxiliary rotational axis, so called. Motion about the auxiliary rotational axis is driven by the second motion device.

First, the fundamentals will be explained which are needed to control the motions along the linear axes by means of the linear drives. For this purpose (contingent upon a predetermined platform position and/or platform orientation) the positions of the near ends of the elongated elements should be determined on the six linear axes.

Figure 2:
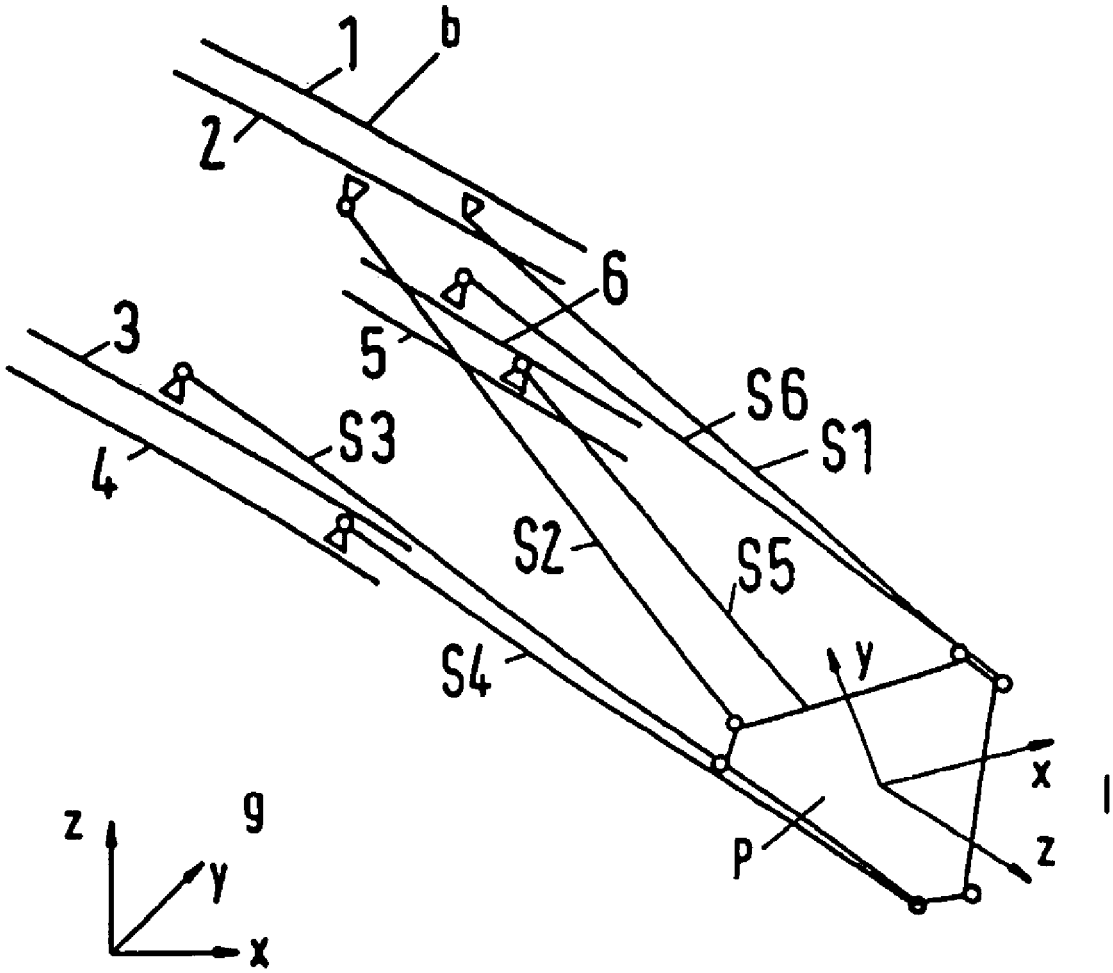
Figure 3:
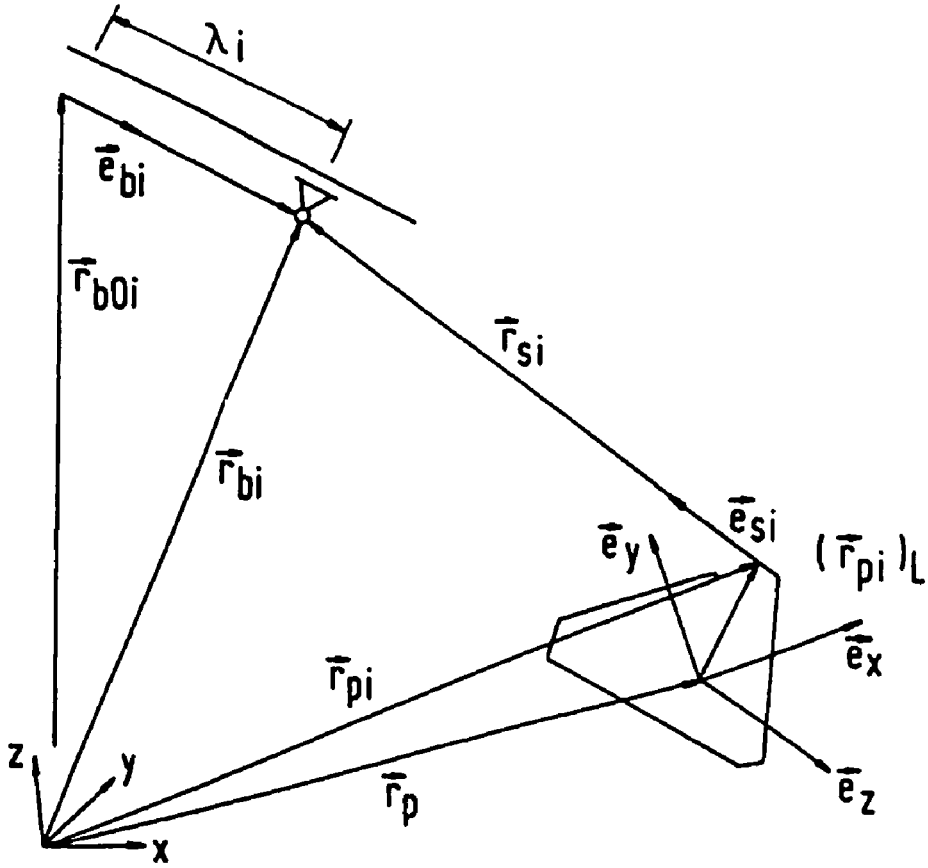

FIG. 2 presents the kinematic design with a global system of coordinates g (laboratory system), a local system of coordinates I locally fixed relative to the platform, a platform P, the six elongated elements S1 to S6 which connect platform P to the linear axes 1 to 6. The near ends of the elongated elements are linearly movable along the linear axes 1 to 6. FIG. 3 shows a sample kinematic chain for linear axis 1.

Position and orientation of platform P can be unequivocally described by local vector $\vec{r}_p$, of the local system of coordinates I which connects the sources of the two systems of coordinates, and by using the three unit vectors $\vec{e}_x$, $\vec{e}_y$, $\vec{e}_z$ of the local system of coordinates I (FIG. 3). The appropriate data can be determined in advance. Any linear displacement of platform P may be expressed (in the global system of coordinates) by a displacement vector $\Delta\vec{r}_p$:

$$(\vec{r}_p)_{neu}=)\ \vec{r}_p)_{alt}+\Delta\vec{r} \tag{1.1}$$

such that the indices "neu" (=new) and "alt" (=old) indicate the local vector of the local system of coordinates before the displacement and after the displacement.

A turn of platform P in space may be described by an orthogonal transformation matrix $\overline{T}$ by transformation of local unit vectors $$(\vec{e}_x)_{neu}=\overline{T}\cdot(\vec{e}_x)_{alt} \tag{1.2a}$$

$$(\vec{e}_y)_{neu}=\overline{T}\cdot(\vec{e}_y)_{alt} \tag{1.2b}$$

$$(\vec{e}_z)_{neu}=\overline{T}\cdot(\vec{e}_z)_{alt} \tag{1.2c}$$

In the local coordinates of platform P, the locations (e.g., intersection points of the cardan joints) of the platform joints (via which the elongated elements S1 to S6 are movably connected to platform P) are predetermined by local vectors $(\vec{r}_{pi})_L$ such that index i can assume values 1 to 6 in keeping with the numbering of the elongated elements S1 to S6. Index L expresses the fact that the local vector has been defined in the local system of coordinates. These six local vectors do not change when the platform moves.

If $$\begin{bmatrix} x_i \\ y_i \\ z_i \end{bmatrix}$$

are the platform coordinates for joint "i", they may also be expressed in the global system of coordinates:

$$\vec{r}_{pi}=\vec{r}_p+x_i\cdot\vec{e}_x+y_i\cdot\vec{e}_y+z_i\cdot\vec{e}_z \tag{1.3}$$

Local vector $\vec{r}_{bi}$ for the axis joint (via which the elongated element is connected to the linear drive) can now be stated, with the as yet unknown repositioning length $\lambda_i$ along the linear axis (in the FIG. 3 sample, along linear axis 1), in the global system of coordinates:

$$\vec{r}_{bi}=\vec{r}_{b0i}+\lambda_i\vec{e}_{bi} \tag{1.4}$$

Herein, $\vec{r}_{b0i}$ is the local vector in the global system of coordinates on the starting point of the axis repositioning path, and $\vec{e}_{bi}$ is the unit vector (in the direction of the repositioning path of the linear axis) along the axis repositioning path. In the knowledge that the rod length is constant, the unknown repositioning length $\lambda_i$ can now be determined as follows:

$$(\vec{r}_{si})^2=(l_i)^2=(\vec{r}_{bi}-\vec{r}_{pi})^2=(\vec{r}_{b0i}+\lambda_i\cdot\vec{e}_{bi}-\vec{r}_{pi})^2 \tag{1.5}$$

This requires working a square equation, in which two solutions exist for $\lambda_i$, of which only one represents a meaningful value as a rule.

The lengths $\lambda_i$ can now be entered into an electronic control system as the preset values for synchronously reaching Freedom of motion and, particularly, the possible angle of rotation of a hexapod platform are limited by the geometry of the elongated elements. In particular, there exists the danger that significant torsion of the platform may result in contact between the elongated elements and in obstruction of a motion of the elements. Besides, it may happen that a limit of the possible angle-of-rotation range is reached and that additional rotating motion cannot be executed. If rotation is desired principally about one axis, the possible angle of rotation can be achieved by means of an additional axis of rotation having a controlled rotational drive, e.g. from a geared servomotor (as is the case, for example, in the second motion device). The object to be moved, e.g. the golf club, can now be attached at the driven parts (=Abtrieb) of this rotating axis (for example, the driven parts of Motor 46).

Figure 4:
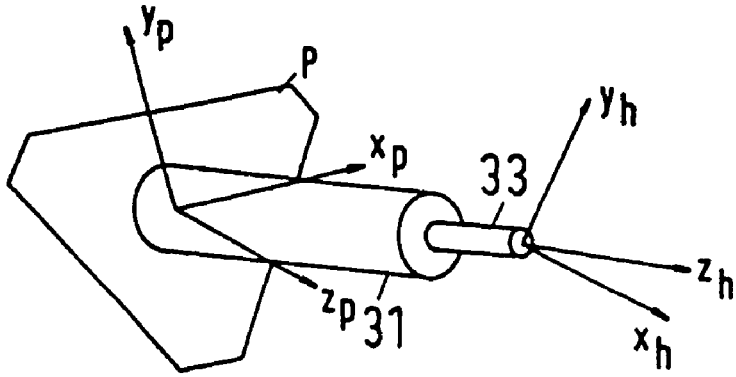

FIG. 4 shows platform P, a portion 31 of the second motion device firmly attached to platform P, and a portion 33 of the parts driven by the motor.

Transformation between the system of coordinates (index h points out this system of coordinates in FIG. 4) at the driven parts (=Abtrieb) ($x_h$, $y_h$, $z_h$) and the system of platform coordinates ($x_p$, $y_p$, $z_p$) (Index P points out the platform) may be achieved with orthogonal matrixes. For the purpose of reaching a rotational speed higher than the speed achievable by the rotational drive alone, it is also possible to co-rotate platform P (by moving the elongated elements).

Figure 5:
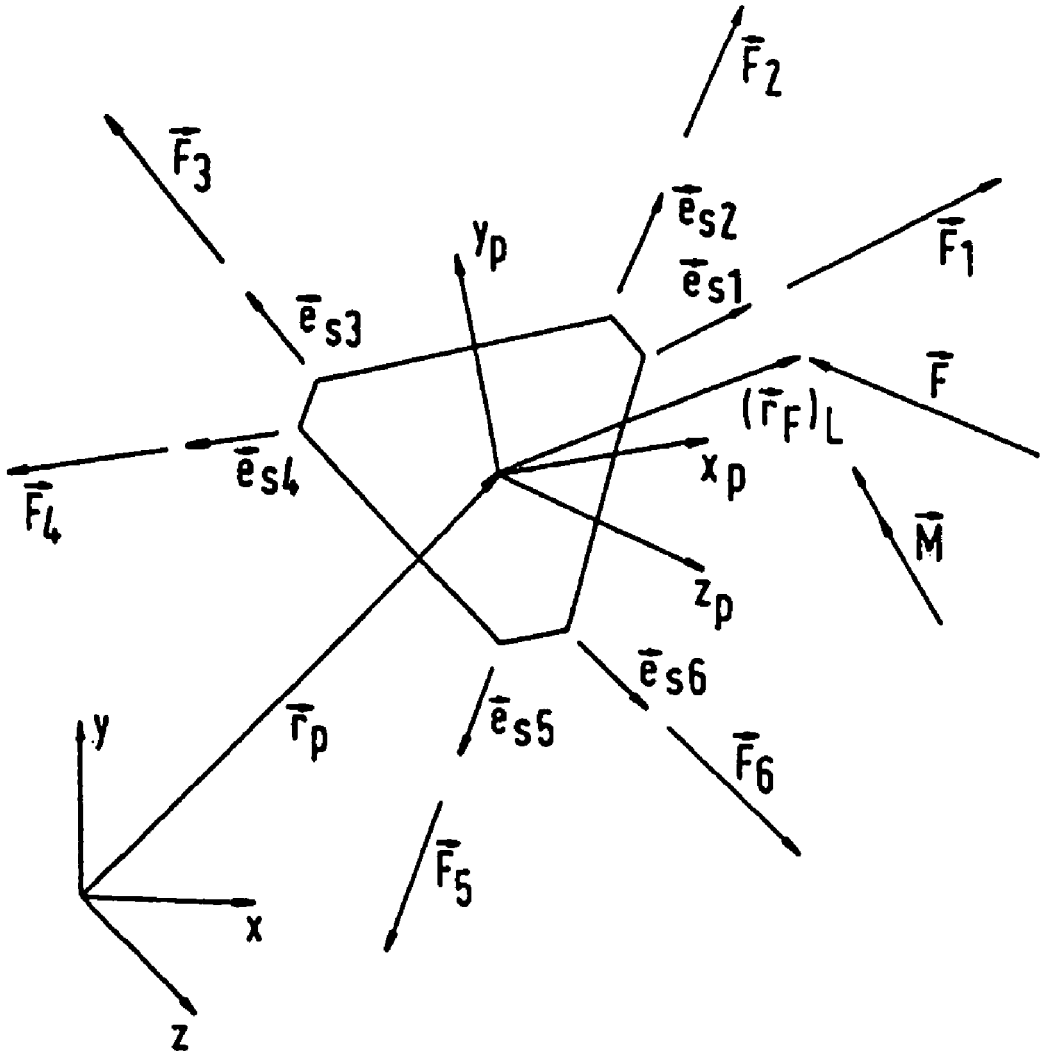

The forces exerted on platform P may be described by the following algorithm (cf. also FIG. 5).

$$\vec{F}_1+\vec{F}_2+\vec{F}_3+\vec{F}_4+\vec{F}_5+\vec{F}_6+\vec{F}=\sum_{i=1}^{6}\vec{F}_i=\vec{0} \tag{2.1}$$

In this case, $\vec{F}_i$ is the longitudinal force along elongated element $S_i$. If transverse forces occurring transversely to the longitudinal direction of the elongated element can be neglected (as is the case with very high approximation in the preferred sample implementation), then all longitudinal forces are parallel with the longitudinal axis. That is to say, the following is true:

$$\vec{F}_i=F_i-\vec{e}_{si} \tag{2.2}$$

In this case, $\vec{e}_{si}$ is the unit vector of elongated element Si (cf. FIG. 3). These longitudinal forces may be determined by use of longitudinal expansion (e.g., measured by means of strain gauges) and/or by electrical voltages of the assigned drive motor. Force $\vec{F}$ (cf. equation 2.1) may arise as a result of weight forces, mass inertia forces, and external forces (the golfer acting upon the platform).

In comparable fashion, the generated moments may be determined by $$\sum_{i=1}^{6}(\vec{r}_i x\vec{F}_i)+(\vec{r}_p+(\vec{r}_F)_L)x\vec{F}+\vec{M}=\vec{0} \tag{2.3}$$

wherein moment $\vec{M}$ may arise as a result of mass moments of inertia and external moments (the golfer's actions) and wherein indicates the cross product of the vectors appearing before and after the operator.

In this case, $(\vec{r}_F)_L$ is the local vector on the origin of force $\vec{F}$, and $\vec{M}$ is an external moment, e.g. the motor moment of the rotational drive.

If the force generated by the golfer is determined in accordance with equation 2.1, it can be determined whether the player generated forces in the direction of a predetermined path of motion or transversely to this direction. This information can be followed interactively by acceleration or deceleration by means of evaluation of the force component in the predetermined direction of motion.

In addition, the golf drive may be followed by evaluation of the quality of the golf swing by evaluating the force component that is transverse to the predetermined direction of motion.

Figure 6:
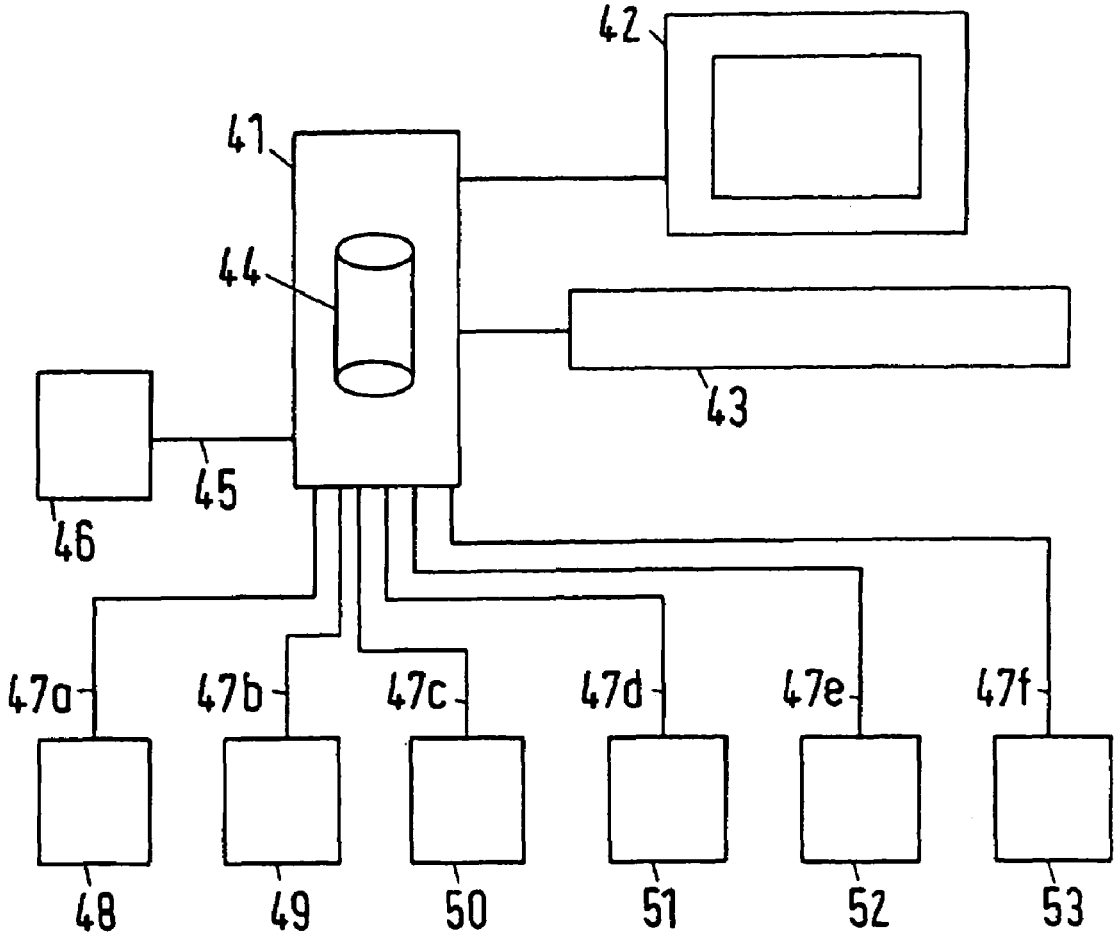

The arrangement illustrated in FIG. 6 is equipped with a control computer 41 with a data memory 44, in which, for example, the above-named data are stored. Control computer 41 serves to control the operation of a golf swing trainer, for example the golf swing trainer of the above-described sample implementation. Control computer 41 may, for example, be a commercially available PC. Control computer 41 is connected to a monitor 42 and to entering means 43, particularly a keyboard and/or a pointing device (e.g., a computer mouse). In this manner, signals may be initiated and appropriate commands generated for controlling the golf swing trainer. Monitor 42 may for this purpose have a touch-sensitive surface, such that the said signals may also be initiated when the surface is touched.

Control computer 41 is connected to each one of drive motors 48 to 53 via control cables 47*a* to 47*f*. Drive motors 48 to 53 are each part of the first motion devices for moving the elongated elements. Moreover, in a specific implementation, there may in each case be a measuring facility designed to measure forces in longitudinal effect in the elongated elements and to transmit appropriate measuring signals to control computer 41.

Furthermore, the concrete sample implementation in FIG. 6 provides a motor 46 for driving a rotational motion of the connector device relative to the platform. Motor 46 is controllable via control cable 45 from control computer 41.

Without restricting the above-described sample implementations, the golf swing trainer may be designed to execute the motion of the golfer and/or the golf club during the golf swing (for example, on an ideal curved path). Therein, the speed of motion need not be commensurate with an ideal swing motion, e.g. while hitting a golf ball. Instead, the swing motion may also be executed at constant and/or lower speed. It is, however, preferable for the golf swing trainer to execute the swing motion with the real speed progressions occurring in the practice of golf.

One possibility is to teach the motion to be executed to the golf swing trainer by executing the motion of the golf club and/or the golfer while the golf club and/or the golfer are/is connected to the golf swing trainer via the connector device. Therein, for example, a plurality of motion positions of the individual motion devices is detected by the control device and the appropriate data are saved, for example, in a memory for coordinates.

It is preferable, however, to generate such data in another manner (for example, by inputting information directly into the control device, as described below) and, for example, to save them in the memory for coordinates.

Furthermore, the time of and/or the time lapse between the motion positions may be set and saved in memory. Alternatively, the motion positions may be saved with constant time lapse between each of two successive motion positions.

The golf swing trainer is capable of reading the data preferably saved in the memory of coordinates and of executing the golf swing motion in accordance with, for example, the motion positions saved in memory. Use of the saved data also permits executing the motion faster or more slowly, for example by raising or lowering the frequency of scanning the data values for the successive motion positions. In a preferred implementation, the coordinates of the motion devices are saved in memory such that scanning the data values for the successive motion positions at constant frequency and given appropriately instant execution of the motion automatically results in a desired (preferably, in the ideal) speed progression of the motion.

The data of the successive motion positions may, for example, be generated by a computer program operating in the manner of a CAD (Computer Aided Design) software used in mechanical engineering. In this case, the curve of the motion path and/or the speed of motion may have been adapted to the characteristics and/or skills of an individual golfer. A plurality of data sets may be saved and accessible to the control device, such that each data set corresponds to one golf swing.

There is the preferred option of changing the saved curve of the motion path by changing one or several of the motion positions by means of a suitable input device of the control device. The input device has, for example, a computer keyboard and/or a pointing device (e.g., a computer mouse). This permits visible representation of the motion corresponding to the momentarily saved data and/or of the changed data by means of appropriate representation devices (e.g., a computer monitor).

In one preferred implementation, for example, the input device named above can establish points on an ideal motion path, which must be passed through during a golf swing. The control device is capable of calculating and saving motion positions of the motion devices corresponding to these points. Furthermore, the control device can automatically generate additional points for the ideal motion path based on the established points (e.g., by spline interpolation).

For the purpose of editing the curve of the motion path before or after saving the data in memory, a graphic user interface may be used. Herein, the swing curve is, for example, shown in a plane through which the golf club passes during the golf swing. Since this plane is not locally fixed in relation to the laboratory system of coordinates (e.g., the floor's system of coordinates) during the golf swing, an appropriate transformation of the coordinates of the motion positions may be implemented for the purpose of representation. In addition, the geometry of the path curve may be edited vertically with respect to the plane. For this purpose, partial segments of the path curve may be edited through use of Bezier Curves. Thereby, from individual points along the path curve, it is possible to:

a) change the location,
b) change the tangent of the swing path,
c) change a curvature of the curve and/or
d) change an angle of the golf club shaft.

Furthermore, it is preferred that forces at work longitudinally on the elongated elements be measured (e.g., by means of strain gauges). In particular, the elongated elements can each comprise a measuring sensor designed to facilitate, during transmission of forces longitudinally along the appropriate elongated element, a measurement of the length of the elongated element corresponding to the momentarily acting force in a longitudinal direction and/or a change in the length. The measurement sensor of the measuring device is preferably arranged on the distant end of the elongated element. In this implementation, the mass present between the measurement sensor and the golfer and/or the golf club is smaller, permitting more precise calculation of the motion performed by the connector device on the basis of the measured values. In order to obtain a greater measurement signal, it is proposed that the elongated elements be designed to be weaker with regard to their resistance to lengthwise change by longitudinal forces at the measurement locations (the places to which the measurement sensor is attached) than in other lengthwise portions of the elongated element. For example, when a rod is used as an elongated element, material is removed at the measuring location, such that merely two opposing areas of material remain transversely to the lengthwise direction, in the manner of a two-pronged fork.

Alternatively, or additionally, forces and/or moments generated by drive devices (e.g., motors and/or drive elements connected thereto, such as toothed belts) may be measured and/or calculated from control signals for controlling the drive devices. For example, the forces at work longitudinally along the elongated elements may be added (as vectors) to the total force at work between the base and the platform. When the second motion device is provided, the force exerted by it and/or the torque moment exerted by it may be measured.

In all instances, it is possible to determine from the measurement values which forces and/or moments were exerted by the golfer during the swing motion. Comparison is made possible, for example, by appropriate calculated values or by measured values derived from a swing motion (e.g., one ideal for the golfer) executed without the golfer. For example, for this purpose, the golf club is merely connected to the connector device, and the swing motion is executed. Determination of the forces and/or moments exerted by the golfer makes it possible to analyse the swing motion executed by the golfer and/or automatically correct them by means of the golf trainer. In the latter instance, the golfer senses the additional forces and/or moments exerted by the golf trainer. In particular, the comparison permits assignment of values characterising the golf swing to individual points and/or regions along the motion path, e.g. acceleration values and/or improperly executed forces and/or moments which were too powerful or too weak. Stated in a more general manner, analysis is thus possible regarding individual segments of the motion path and/or the golf swing. Therein, the analysis is preferably performed in fully automated fashion by the control device and, possibly, contingent upon a preselected mode.

In particular, the following modi of the golf swing trainer may be selected:

1. A golf swing, or partial segments thereof, may be multiply repeated. Therein, the golf swing may be executed by the golf swing trainer along a predetermined path curve at a preset speed.
2. This mode proceeds as in Mode 1, except that the golfer may determine and/or change the speed progression along the predetermined path curve by application of force. For example, the application of force is determined by above equation 2.1. Therein, force is composed of the external force exerted by the golfer, the mass inertia forces, and the weight forces. The weight forces may be measured on a scale or by test operation of the golf swing trainer. The mass inertia forces may be analytically determined from the accelerations. Moreover, forces may be measured, as described, by use of strain gauges in the elongated elements. It is thus possible to determine the external force repeatedly within short periods of time. Now, if a force component of external force is determined in the direction of the momentarily predetermined path curve, then the speed of the motion along the path curve is increased or decreased, depending on the direction in which the force component is changed. Therein, for example, the speed may be increased in proportion to the force component. In other words: If the golfer wishes to accelerate the motion, therefore exerting additional external force with a force component in the direction of the path curve, then this is noted, and the golf swing trainer increases the speed.
3. In this mode, the golfer can change the path curve by applying force. However, the required force is smallest at any time during the motion if the motion is executed along the predetermined path curve. Preferably, the golf trainer exerts, in that case, a restoring force in the direction of the ideal path curve which is, for example, proportional to the distance of the montary location of the actually executed path curve from the location of the ideal path curve. The corresponding location of the ideal path curve may, for example, be the location immediately next to the momentary location, or it may be the location which would have been reached if an ideal golf swing had been executed with ideal speed progression at the momentary time. Therein, the factor of proportionality may be contingent on the momentary location and/or contingent upon the corresponding location of the ideal path curve.

Switching between the modi is freely possible. For example, the golf swing ideal for the player may first be rehearsed in Mode 1 and then repeatedly practiced in Mode 2 and/or Mode 3. The training process develops "muscle memory", i.e. the player will unconsciously retain the ideal golf swing.

In a preferred process, certain points (for example, the "nine o'clock" point so called in golf parlance) on the path curve of the golf swing are occupied by the golfer while he and/or the golf club are connected to the connector device. There are now two possibilities: One, the position can be corrected by a person (e.g., by an expert) by giving appropriate commands (e.g., via a graphic interface) to the control device, such that the point to be set in the data of the control device will be changed. Or two, the player (for example, following instructions given by an expert) can change his physical stance, such that appropriate forces and/or moments are exerted upon the golf swing trainer. These forces and/or moments may be measured (for example by strain gauges, as described above), and the control device can, on this basis, calculate the corrected position of the point on the path curve to be determined.

Figure 7:
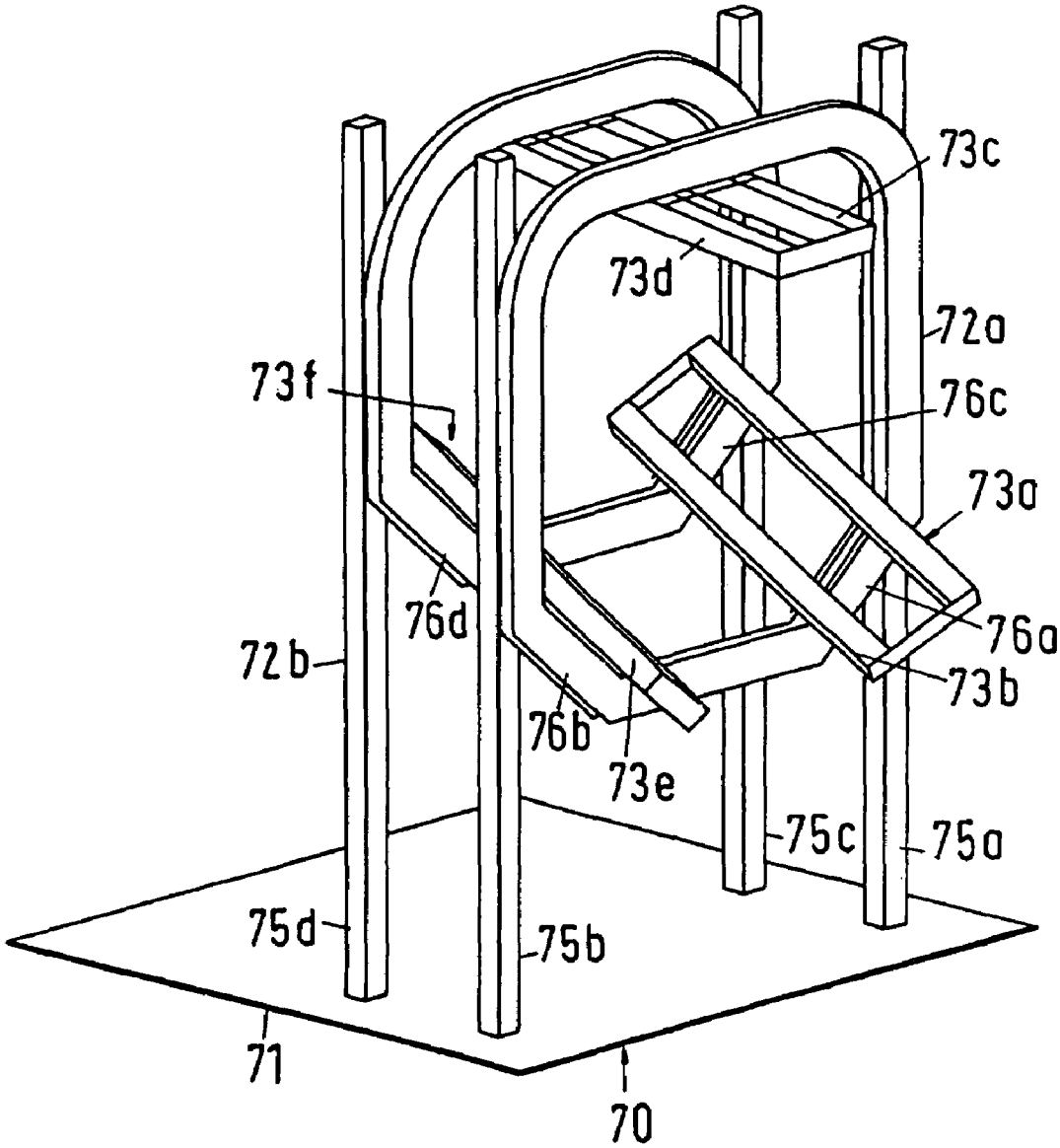

The base 70 illustrated in FIG. 7 comprises a floor plate 71 and two frames 72*a*, 72*b*, each having two feet 75*a*, 75*b* and 75*c*, 75*d*. Feet 75*a*, 75*b* and 75*c*, 75*d* are attached to floor plate 71. Frames 72*a*, 72*b* each form a window-like opening in the manner of a picture frame, such that the lower edge of the opening of frame 72*a* is arranged more closely to the floor plate than the lower edge of the opening of frame 72*b*. The lower edge of both frames 72*a*, 72*b* merges at both of its opposing ends into a frame section 76*a*, 76*b* and 76*c*, 76*d* running diagonally upward. The upper edges of frames 72*a*, 72*b* are located approximately at the same height above floor plate 71.

Base 70 comprises a total of three pairs of two linear guiding devices 73*a*, 73*b* and 73*c*, 73*d* and 73*e*, 73*f* which define linear axes along which the elongated elements (e.g., elements S1 to S6 as shown in FIG. 1 and FIG. 2) may be moved in a linear fashion. The two linear guiding devices 73*a*, 73*b* and 73*c*, 73*d* and 73*e*, 73*f* are all parallel with respect to each other. However, in an alternative implementation, they may also not be parallel with respect to each other.

Linear guiding devices 73*c*, 73*d* slope slightly from top back to front bottom toward the horizontal. This is achieved by attaching linear guiding devices 73*c*, 73*d* to the upper edges of frames 72*a*, 72. On the other hand, linear guiding devices 73*a*, 73*b* and 73*e*, 73*f* are inclined toward floor plate 71. This is achieved by attaching linear guiding devices 73*a*, 73*b* and 73*e*, 73*f* to diagonally-upward-running frame sections 76*a*, 76*b* in their forward portion, and to diagonally-upward-running frame sections 76, 76*d* in their rear portion.

At least frames 72*a*, 72*b* of base 70 should preferably be made of metal, in particular of steel profiles.

Figure 8:
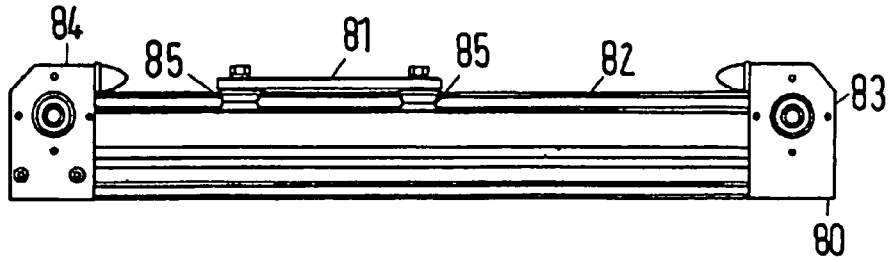
Figure 9:
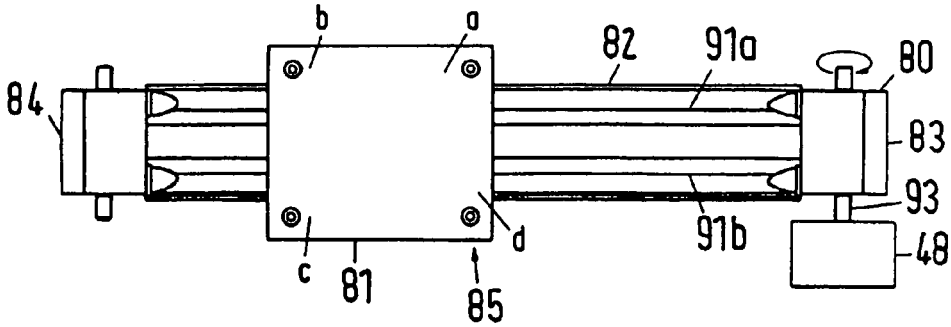

Linear forward feed 80 shown in FIG. 8 and FIG. 9 comprises a slide 81 which can be moved in a straight line, i.e. from right to left in the illustration. A midsection 82 of linear forward feed 80 extending along the corresponding linear axis holds two toothed belts 91*a*, 91*b* which are each turned around in opposing end pieces 83, 84. Instead of such a toothed-belt drive, a ball screw drive (=Wälzschraubtrieb) or roller screw drive (=Wälzschraubtrieb) may be used, for example. As shown in FIG. 9, a shaft 93 is connected to a drive motor 48. Linear forward feed 80, together with drive motor 48, constitutes a first motion device for moving a near end of an elongated element. In particular, all linear guiding devices 73 as in FIG. 7 may be formed in the manner of this type of linear forward feed 80.

Toothed belts 91*a*, 91*b* are driven by drive motor 48 via shaft 93, such that a rotating motion of shaft 93 is converted into a linear motion along the linear axis. Slide 81, for example, is threaded through midsection 82, at the outside of which rollers move during the linear motion.

Figure 10:
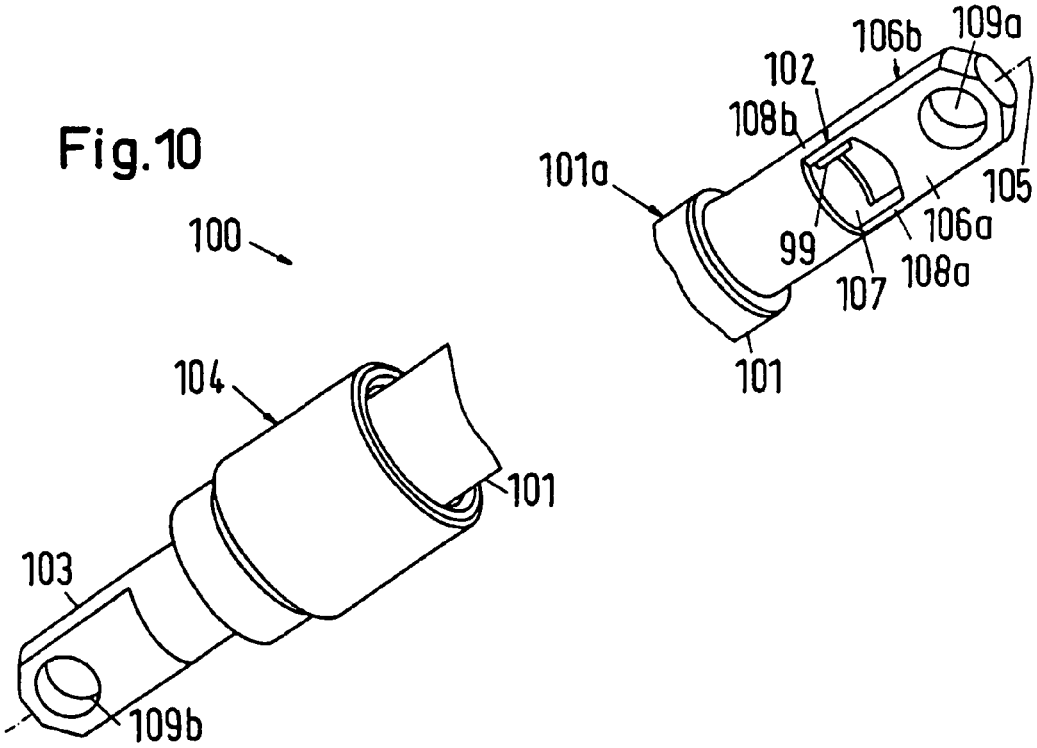

The elongated element 100 shown in FIG. 10 is, for example, used in the implementation illustrated in FIG. 1 and FIG. 2 as elongated element S1 to S6. It comprises a rod-shaped, hollow-cylinder midsection 101 whose rotational axis extends longitudinally along element 100. Midsection 101 is not completely shown in FIG. 10. In general, it is much longer than in the illustration.

A first end 103 of element 100 is designed to be connected to a base via a joint (in particular, a cardan joint). A second end 102 opposing first end 103 longitudinally is designed to be connected to a platform via a joint (in particular, a cardan joint). Second end 102 is made from a solid cylinder and is connected to midsection 101 in a non-rotating manner, e.g. welded to midsection 101 in its end portion 101*a*. In the direction of longitudinal axis 105, which, in the midportion of element 100, is identical with the rotational axis, and prior to attaching second end 102 to midsection 101, a pocket hole was drilled and material was removed from two opposing sides perpendicularly to longitudinal direction 105, such that two opposing parallel surfaces 106*a*, 106*b* were created. The lengthwise sections which extend in longitudinal direction 105, from which material was removed and which contain the pocket hole, overlap. Thus, a window 107 has been created in the overlapping area which extends from the one surface 106*a* to the other surface 106*b*. Thereby, two links 108*a*, 108*b* paralleling longitudinal direction 105 have been created as edges of window 107. Since forces occur in longitudinal direction 105, these links 108*a*, 108*b* represent the weakest sections in element 100. Therefore, changes in the length of element 100 brought about by the forces can be optimally measured at these sections. A strain gauge 99 is attached parallel to longitudinal direction 105 and preferably on the inside of one of the links 108*a*, 108*b*.

Preferably, a strain gauge 99 is used, wherein an electrical resistance of a material of the strain gauge 99 connected to link 108 will change with the length of link 108 parallel with longitudinal direction 105. This electrical resistance is measured, for example, via an electrical resistance bridge. This type of strain gauges is commercially available and may also be used in other implementation styles of the elongated element.

Electrical connecting cables of the strain gauge are preferably led to the platform, thence being led onward, in particular together with the connecting cable of the second motion device. The strain gauge 99 may be connected to control device 41 as described in FIG. 6 in which the measurement signals of the strain gauge 99 are evaluated.

With the possible exception of parts of revolute joint 104, element 100 should preferably be made of aluminum and/or carbon fiber reinforced plastic.

Ends 102, 103 of element 100 each are provided with a through hole 109*a*, 109*b* running transverse to longitudinal direction 105, such that a pin (cf., for example, FIG. 12) may be inserted through hole 109*a*, 109*b* facilitating a movable mechanical connection of element 100 with some other structural element. This point will be discussed in greater detail below. A friction bearing is pressed into each of through holes 109*a*, 109*b*.

Furthermore, element 100 comprises a revolute joint 104 which, for example, connects one end of midsection 101 with end 103. Revolute joint 104 permits turning ends 102, 103 about longitudinal axis 105. Revolute joint 104 is preferably a joint with at least one ball bearing.

Figure 11:
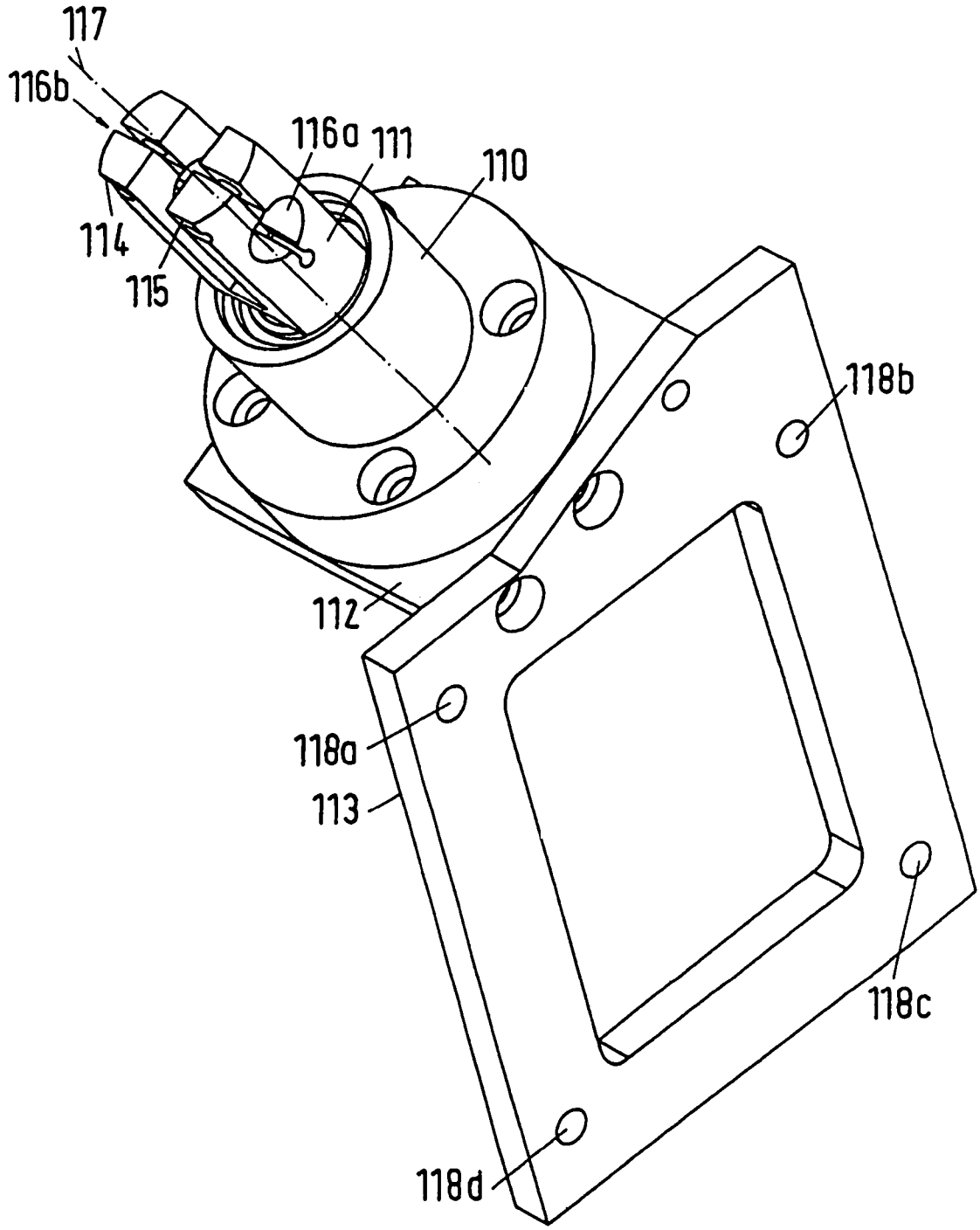
Figure 12:
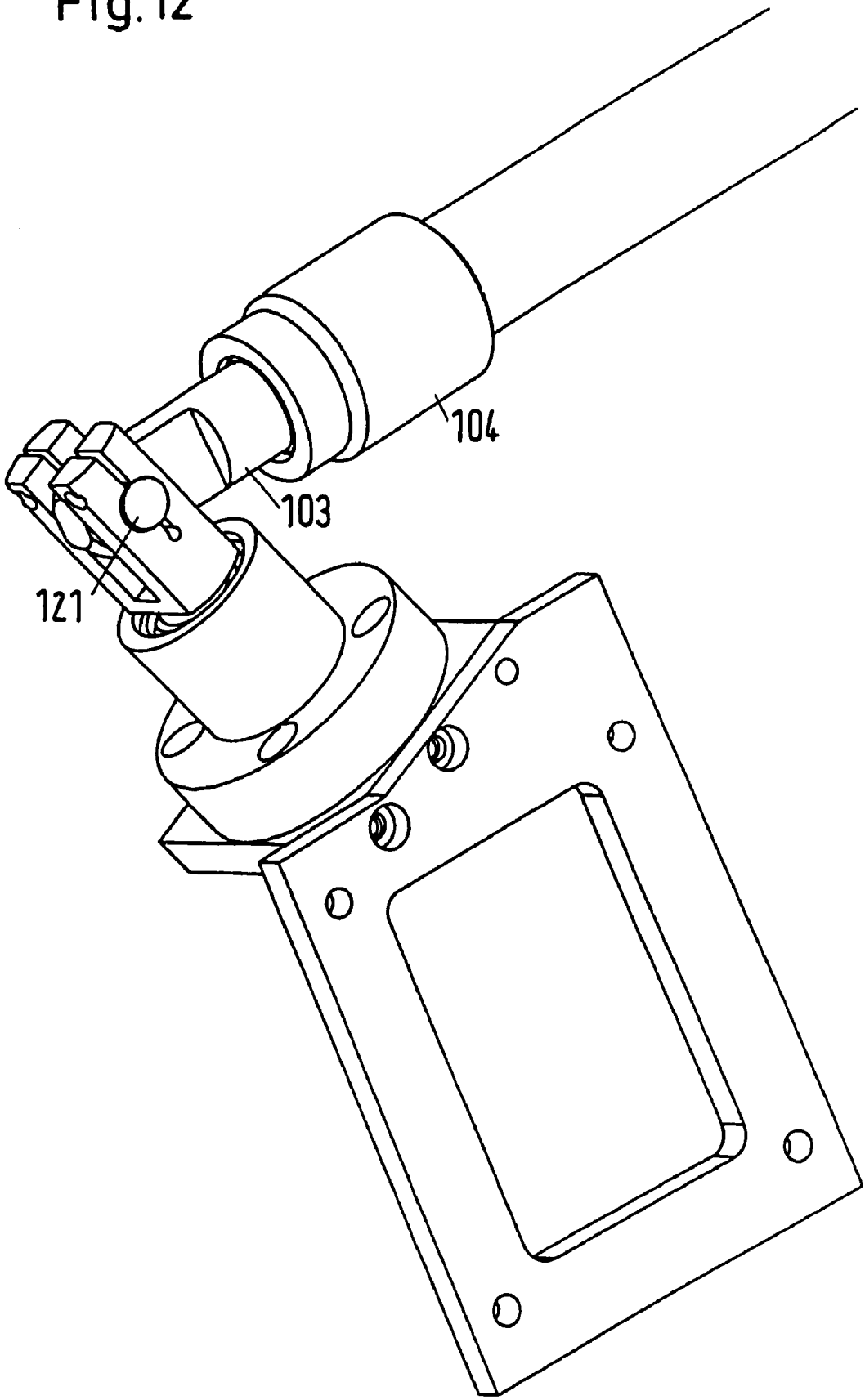

The joining piece illustrated in FIG. 11 and FIG. 12 is used, for example, as joining piece A5 as shown in FIG. 1. It comprises a transition piece 113 which is connected to the first motion device.

The joining piece also comprises a revolute joint 110. Preferably, revolute joint 110 is arranged at a distance from slide 81 if attached thereto. The array is implemented in a manner which would array revolute joint 110 above slide 81 as illustrated in FIG. 8. Therein, the lower edge of transition piece 113 runs approximately in the direction of the linear axis. This guarantees a great range of mobility for the motion of the elongated element.

Revolute joint 110 is attached to transition piece 113 via an elbow piece 112. Therein, rotation axis 117 of revolute joint 110 slants upward when viewed from the lower edge of transition piece 113. The terms "below" and "above" refer exclusively to the illustration in FIGS. 8, 11 and 12. During operation of the golf swing trainer, the lower edge of transition piece 113 may, for example, be on top as well (for example, if it is attached to linear guiding device 73*c*).

Revolute joint 110 comprises a fork 111 which can be turned about rotation axis 117 relative to elbow piece 112. Preferably, revolute joint 110 is equipped with ball bearings. Fork 111 comprises two prongs 114, 115, which point their free ends away from elbow piece 112. Prongs 114, 115 each comprise a through hole 116*a*, 116*b* vertical to rotation axis 117 and level with each other. As may be seen in FIG. 12, an elongated element, for example elongated element 100 as shown in FIG. 10, may have its end (e.g., end 103) inserted between prongs 114, 115, and a pin or bolt 121 may be inserted into through holes 116*a*, 116*b* and into through hole 109*b*, such that a cardan joint is formed by the through holes, the bolt or pin, and revolute joint 110.

For example, transition piece 113 is connected to slide 81 as shown in FIG. 8 and FIG. 9 by means of through holes

118*a*, 118*b*, 118*c*, 118*d* in transition piece 113 in such manner that through hole 118*a* is arranged in area a of slide 81 (cf. FIG. 9), through hole 118*b* in area b of slide 81, through hole 118*c* in area c of slide 81, and through hole 118*d* in area d of slide 81. Additional structural elements may be used to fasten and support transition piece 118 securely. Thus, in FIG. 9, revolute joint 110 would extend beyond the upper edge of slide 81, and axis of rotation 117 points diagonally upward toward the right. Linear forward feed 80 is then, for example, used as linear guiding device 73*b* of base 70, in which case the end having motor 48 in the illustration of FIG. 7 would be arranged on top at rear. In order to save space, motor 48 may be arranged at the opposite joining element of shaft 93.

The golf swing trainer is preferably designed such that the elongated elements (as shown in FIG. 12) are tilted at a minimum angle of 10 degrees and a maximum angle of 80 degrees, in particular at a minimum angle of 20 degrees and a maximum angle of 70 degrees, toward axis of rotation 117 of revolute joint 110. This guarantees precise and stable control of the motions of the platform and/or facilitates jolt-free transmission of forces from the linear forward feeds via the elongated elements to the platform.

Figure 13:
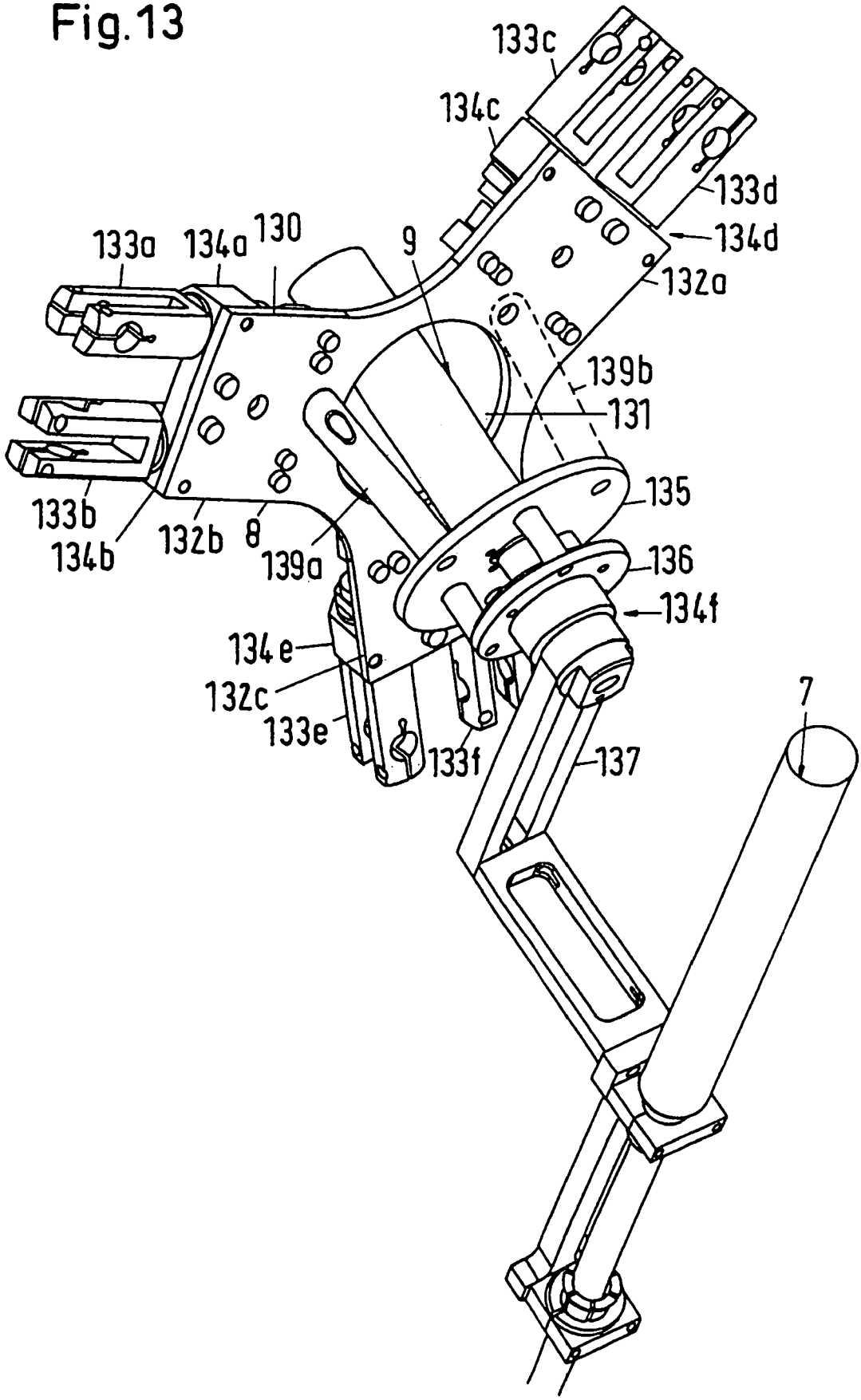

As an example, a platform 8 of the golf swing trainer is designed as shown in FIG. 13. A slab-shaped element 130 has a central cutout 131. Situated in the plane of a surface of slab-shaped element 130, extensions 132*a*, 132*b*, 132*c* of slab-shaped element 130 extend in three directions. The directions, in pairs, jointly enclose a 120 degree angle. Axes of rotation of revolute joints 134*a* to 134*f* are parallel with these directions, pairs of the revolute joints being attached parallel to each other to one of extensions 132*a*, 132*b*, 132*c*. In a manner similar to revolute joint 110 as shown in FIG. 11, the revolute joints have forks 133*a* to 133*f*, each with two prongs, permitting distant ends of the elongated elements, in a manner similar to that shown in FIG. 12, to be movably secured in forks 133*a* to 133*f* by means of a pin or bolt, such that a cardan joint is created in each case.

The body of a motor 9 (in particular, a servomotor) is inserted through central cutout 131, motor 9 being capable of rotating, relative to platform 8, a connector device 137 (which, for example, is connector device 10 shown in FIG. 1) connected to platform 8. The axis of rotation is titlted versus the normal surface plane of the surface of slab-shaped element 130, e.g. by an angle of 20 to 30 degrees. Preferably, the axis of rotation is arranged so as to be approximately perpendicular to a plane in which the shaft of golf club 7 moves during the golf swing. Such a plane exists only in approximation. However, position and orientation of the shaft during golf swing may easily be corrected by a motion of platform 8.

Slab-shaped element 130 is connected to a fastening device 135, 136 via three connector rods 139*a*, 139*b*, of which only two are visible in FIG. 13. A stator of motor 9 is attached to this fastening device 135, 136, which has two circular disks arranged parallel to each other. The rotor of motor 9 is connected to connector device 137, which is designed in the form of a crank in order to receive appropriate transmission of moments.

The rotor is seated in circular disk 136 by means of a double helical ball bearing, in order to keep the shaft of motor 9 free of forces running transversely to the axis of rotation.

The invention claimed is:

1. Golf swing trainer, comprising:

a plurality of six elongated elements, each of which has a near end and a distant end;

a plurality of first motion devices, wherein each one of said plurality of first motion devices is connected to a corresponding one of said plurality of six elongated elements at the near end of the corresponding elongated element and is designed to move said corresponding elongated element;

a platform movably connected to each one of said distant ends of said plurality of six elongated elements; and a connector device connected to said platform.

2. The trainer of claim 1 wherein said connector device is designed to connect to at least one of a golf club and a golfer.

3. The trainer of claim 1, further comprising a base wherein each of said plurality of first motion devices is designed to move the corresponding elongated element relative to the base.

4. The trainer of claim 3 wherein at least one of said plurality of six elongated elements is connected to said base via a cardan joint.

5. The trainer of claim 3, wherein said plurality of first motion devices are linear motion devices, wherein each of said plurality of first motion devices is designed to move said near end of one of the plurality of elongated elements linearly along one of a plurality of straight lines, and wherein each of said plurality of straight lines is locally fixed relative to the base.

6. The trainer of claim 1 wherein motion of said plurality of six elongated elements is designed to constrain motion of a golf swing when said connector device is connected to at least one of a golf club and a golfer.

7. The trainer of claim 1, further comprising a control device wherein said control device is connected to each of said plurality of first motion devices, such that motions of said plurality of first motion devices are controlled by said control device.

8. The trainer of claim 1 wherein at least one of said plurality of six elongated elements is connected to said platform via a cardan joint.

9. The trainer of claim 1 wherein at least one of said plurality of six elongated elements comprises a revolute joint, such that said near end and said distant end of said at least one of said plurality of six elongated elements can be independently rotated about a longitudinal axis of said at least one of said plurality of six elongated elements.

10. The trainer of claim 1, further comprising a base wherein each of said plurality of six elongated elements is connected to said base, wherein said trainer is designed such that forces between said base and said platform are transmitted exclusively in directions that are longitudinal directions of, in each case, a corresponding one of said plurality of six elongated elements, and wherein each of said longitudinal directions is defined by a connection line from said near end and said distant end of said corresponding one of said plurality of six elongated elements.

11. The trainer of claim 1 wherein said platform is rotatably connected to said connector device, wherein a second motion device is provided, and wherein said second motion device is designed to rotate said connector device about an axis of rotation relative to said platform.

12. The trainer of claim 11 wherein said distant ends of said plurality of six elongated elements are attached to said platform in a plane of impact and wherein said axis of rotation is tilted with respect to a direction which is perpendicular to said plane of impact.

13. The trainer of claim 12 wherein each of said plurality of six elongated elements is connected to said platform via a cardan joint, wherein each cardan joint comprises two axes of rotation about which a corresponding one of said plurality of six elongated elements and said platform can be rotated, wherein said two axes of rotation intersect at an intersection point, and wherein said intersection points are located in said plane of impact.

14. The trainer of claim 1, wherein at least one of said six elongated elements comprises a measuring sensor designed to measure at least one of a length and a change in said length, wherein said length is a length of said at least one of said six elongated elements in a longitudinal direction of said at least one of said six elongated elements.

15. The trainer of claim 14, wherein said length corresponds to a momentarily effective force in said longitudinal direction.

16. The trainer of claim 14, wherein said measuring sensor is arranged near said distant end of said at least one of said plurality of six elongated elements.

17. A method for training a golf swing, comprising:

performing motion of a platform of a golf swing trainer by moving a plurality of six elongated elements, wherein each of said plurality of six elongated elements comprises a near end and a distant end, and wherein said platform is movably connected to each one of said distant ends of said plurality of six elongated elements; and using a connector device for transfer of said motion of said platform to at least one of a golf club and a golfer.

18. The method of claim 17 wherein said motion of said platform is effected by controlling motion of said near ends of said plurality of six elongated elements relative to a base of said golf swing trainer.

19. The method of claim 18 wherein said motion of said platform is effected by controlling motion of said near ends of said plurality of six elongated elements along linear axes which are locally fixed relative to said base.

20. The method of claim 17 wherein a length of at least one of said plurality of six elongated elements, which is defined by a distance between said near end and said distant end, is constant during said motion of said platform, besides changes in length due to mechanical compression and elongation of solid material of said plurality of six elongated elements caused by transmission of forces.

21. The method of claim 17 wherein, in order to perform said motion of said platform, forces are transmitted between said near end of at least one of the plurality of elongated elements and said platform, and wherein said forces are exclusively transmitted in a longitudinal direction, which is defined by a connection line from said near end and said distant end of said at least one of said plurality of six elongated elements.

22. The method of claim 17 wherein a total of six of said plurality of six elongated elements are used for performing said motion of said platform.

23. The method of claim 17 wherein said connector device is rotated relative to said platform during said transfer of said motion of said platform to said golf club and/or to said golfer.

24. The method of claim 17 wherein a measurement of forces acting in a longitudinal direction of the elongated elements is performed.

25. The method of claim 24 wherein operation of said golf swing trainer is controlled in dependence on a result of said measurement.

26. A method of manufacturing a golf swing trainer, comprising:

providing a plurality of six elongated elements, each of which has a near end and a distant end;

providing a plurality of first motion devices, each of said plurality of first motion devices is designed to move at least one of said plurality of six elongated elements;

connecting each one of said first motion devices to a corresponding one of said plurality of six elongated elements at the near end of the corresponding elongated element;

providing a platform;

movably connecting said platform to each one of said distant ends of said plurality of six elongated elements; and connecting a connector device to said platform wherein said connector device is designed to connect said platform to at least one of a golf club and a golfer.

27. The method of claim 26 wherein the step of connecting said connector device to said platform is performed so that said platform can be rotated relative to said golf club and/or to said golfer.

* * * * *